US011326299B2

(12) United States Patent
Dawidiak

(10) Patent No.: US 11,326,299 B2
(45) Date of Patent: May 10, 2022

(54) HOUSEHOLD APPLIANCE

(71) Applicant: ELECTROLUX APPLIANCES AKTIEBOLAG, Stockholm (SE)

(72) Inventor: Bartosz Dawidiak, Stockholm (SE)

(73) Assignee: Electrolux Appliances Aktiebolag

( * ) Notice: Subject to any disclaimer, the term of this patent is extended or adjusted under 35 U.S.C. 154(b) by 115 days.

(21) Appl. No.: 16/626,623

(22) PCT Filed: Jul. 5, 2017

(86) PCT No.: PCT/EP2017/066773
§ 371 (c)(1),
(2) Date: Dec. 26, 2019

(87) PCT Pub. No.: WO2019/007496
PCT Pub. Date: Jan. 10, 2019

(65) Prior Publication Data
US 2020/0224349 A1 Jul. 16, 2020

(51) Int. Cl.
*D06F 33/00* (2020.01)
*A47L 15/42* (2006.01)
(Continued)

(52) U.S. Cl.
CPC ..... *D06F 39/12* (2013.01); *A47L 15/4274* (2013.01); *A47L 15/4293* (2013.01);
(Continued)

(58) Field of Classification Search
CPC ..... A47L 15/4274; A47L 15/4293; A47L 15/0063; A47L 2501/26; A47L 15/46; D06F 33/00; D06F 39/12
See application file for complete search history.

(56) References Cited

U.S. PATENT DOCUMENTS 6,456,242 B1 9/2002 Crawford
7,155,213 B1 12/2006 Almeda et al.
(Continued)

FOREIGN PATENT DOCUMENTS

DE 10 2013 201575 A1 7/2014
EP 2 363 055 A1 9/2011
(Continued)

OTHER PUBLICATIONS

International Search Report and Written Opinion for Application No. PCT/EP2017/066773 dated Mar. 8, 2018, 11 pages.
(Continued)

*Primary Examiner* — Benjamin L Osterhout
(74) *Attorney, Agent, or Firm* — RatnerPrestia

(57) ABSTRACT

A household appliance is disclosed that may perform a useful cycle of operation on an item. The household appliance may include a treating chamber for accommodating the item during the performance of the useful cycle, and a body enclosing the treating chamber. The body may include a front side, an underside, a first delimiting surface and a second delimiting surface, wherein the first and second delimiting surfaces forms a recess between the underside and the front side. The first delimiting surface may be essentially parallel to the underside of the body. The household appliance may further include a communication module configured to wirelessly transmit and/or receive data. The communication module may be arranged at the first delimiting surface.

14 Claims, 2 Drawing Sheets

(51) Int. Cl.
*D06F 39/12* (2006.01)
*A47L 15/00* (2006.01)
*A47L 15/46* (2006.01)

(52) U.S. Cl.
CPC ..... *A47L 15/0063* (2013.01); *A47L 15/46* (2013.01); *A47L 2501/26* (2013.01)

(56) References Cited

U.S. PATENT DOCUMENTS

| | | | |
|---|---|---|---|
| 7,363,031 | B1 | 4/2008 | Aisa |
| 8,526,935 | B2 | 9/2013 | Besore et al. |
| 9,375,125 | B2 | 6/2016 | Cottrell et al. |
| 9,510,723 | B2 | 12/2016 | Cottrell et al. |
| 9,513,613 | B2 | 12/2016 | Ahn et al. |
| 9,531,860 | B2 | 12/2016 | Yum et al. |
| 9,595,831 | B2 | 3/2017 | Lee et al. |
| 9,667,070 | B2 | 5/2017 | Lee et al. |
| 9,685,784 | B2 | 6/2017 | Lee et al. |
| 9,690,684 | B2 | 6/2017 | Ahn et al. |
| 9,836,803 | B2 | 12/2017 | Ahn et al. |
| 9,882,262 | B2 | 1/2018 | Sippel |
| 9,924,849 | B2 | 3/2018 | Gary, Jr. et al. |
| 9,948,478 | B2 | 4/2018 | Ha |
| 9,951,451 | B2 | 4/2018 | Park et al. |
| 9,979,201 | B2 | 5/2018 | Seo et al. |
| 10,004,376 | B2 | 6/2018 | Cottrell et al. |
| 10,012,971 | B2 | 7/2018 | Pietsch et al. |
| 10,177,932 | B2 | 1/2019 | Boeldt et al. |
| 10,271,709 | B2 | 4/2019 | Gary, Jr. et al. |
| 10,296,989 | B2 | 5/2019 | Ahn et al. |
| 10,307,034 | B2 | 6/2019 | Cottrell et al. |
| 10,326,198 | B2 | 6/2019 | Yikilmazcinar et al. |
| 10,366,372 | B2 | 7/2019 | Jones et al. |
| 2010/0102076 | A1 | 4/2010 | Hendrickson et al. |
| 2011/0085287 | A1 | 4/2011 | Ebrom et al. |
| 2014/0174889 | A1 | 6/2014 | Cottrell et al. |
| 2015/0359406 | A1 | 12/2015 | Hering et al. |
| 2016/0095493 | A1* | 4/2016 | Gary, Jr. ..... A47L 15/0063 134/57 DL |
| 2016/0231723 | A1 | 8/2016 | Pietsch et al. |
| 2017/0079501 | A1 | 3/2017 | Heiligenmann |
| 2017/0187091 | A1 | 6/2017 | Acker et al. |
| 2018/0198638 | A1 | 7/2018 | Ha |
| 2018/0202093 | A1 | 7/2018 | Park et al. |
| 2019/0073800 | A1 | 3/2019 | Lochny |
| 2019/0208981 | A1 | 7/2019 | Gary, Jr. et al. |
| 2019/0239714 | A1 | 8/2019 | Cottrell et al. |
| 2019/0258367 | A1 | 8/2019 | Root |

FOREIGN PATENT DOCUMENTS

| | | | |
|---|---|---|---|
| EP | 2 385 309 | A1 | 11/2011 |
| JP | 2010 142318 | A | 7/2010 |
| WO | WO 2011/080146 | A1 | 7/2011 |
| WO | WO 2015/036229 | A1 | 3/2015 |
| WO | WO 2017/061962 | A1 | 4/2017 |

OTHER PUBLICATIONS

LG HomeChat (Apr. 17, 2015), Retrieved from Internet: URI:http://www.zdnet.com/pictures/top-10-smart-home-gadgets-and-appliances/7/.

* cited by examiner

HOUSEHOLD APPLIANCE

CROSS-REFERENCE TO RELATED APPLICATIONS

This application is a national stage application filed under 35 U.S.C. § 371 of International Application No. PCT/EP2017/066773 filed Jul. 5, 2017 and published as WO2019007496, which application is hereby incorporated by reference herein in its entirety.

TECHNICAL FIELD

The present invention relates to a household appliance comprising a communication module.

BACKGROUND

Household appliances such as dishwashers, refrigerators, freezers, ovens, stoves, washing machines, dryers, etc. are all configured to perform a useful cycle of operation on an item. As an example, a dishwasher is configured to perform a useful cycle of operation in the form of a washing cycle of items such as glasses, cutlery, plates, etc. As further examples, a washing machine is configured to perform a useful cycle of operation in the form of a washing cycle of items such as clothes, and an oven, as well as a stove, is configured to perform a useful cycle of operation in the form of a heating cycle of items, such as food items.

Household appliances are widely spread and are popular since they can perform a task which previously required manual labour. Household appliances usually comprises a control unit configured to control the operation of the household appliance. The operation of a household appliance is associated with several operational aspects. Examples are temperature, intensity of operation, duration of operation, load quantity of items, amount of washing liquid, etc. Development of household appliances has led to household appliances which comprises a communication unit configured to wirelessly transmit and receive data to and from a remote communication unit. This is advantageous since the household appliance can be controlled remotely, or send data to a remote communication unit for example indicating one or more operational aspects of the household appliance.

A problem that arises with such a household appliance is that generally a household appliance is placed at a location of a home which is not advantageous for transmission of wireless signals. Examples are washrooms, toilets, and kitchens. Further, today, it is common and popular to build in household appliances such as refrigerators, freezers, washing machines, dryers, etc., which may have negative impacts on the ability to send and receive wireless signals. This because the material used may block, adsorb, or reflect the wireless signals. If the communication unit of the household appliance is unable to send or receive data from the remote communication unit, the household appliance will be unable to provide the advantages intended. Further, on the market, it is a disadvantage if the household appliance only can be positioned at a certain location to provide the claimed advantages, or has restrictions on the ability to be built in, e.g. only being suitable to be built in using a certain material.

SUMMARY

It is an object of the present invention to overcome, or at least alleviate, at least some of the above-mentioned problems and drawbacks.

According to an aspect of the invention, the object is achieved by a household appliance configured to perform a useful cycle of operation on an item. The household appliance comprises a treating chamber for accommodating the item during the performance of the useful cycle, and a body enclosing the treating chamber. The body comprises a front side, an underside, a first delimiting surface and a second delimiting surface. The first and second delimiting surfaces forms a recess between the underside and the front side. The first delimiting surface is essentially parallel to the underside of the body, wherein the household appliance further comprises a communication module configured to wirelessly transmit and/or receive data. The communication module is arranged at the first delimiting surface.

Since the communication module is arranged at the first delimiting surface, the transmission of wireless signals will be less sensitive to disturbances of surrounding materials giving a greater freedom of positioning the household appliance within a home. This because the communication module is arranged at the first delimiting surface which is a delimiting surface of the recess which provides a path where the wireless signals can be transmitted without having to pass through the material of a surface.

Further, a household appliance is provided having an improved ability to be built in. That is, since the communication module is arranged at the first delimiting surface which is a delimiting surface of the recess, the communication module is located at a position of the household appliance ensuring that the transmission of wireless signals will not be disturbed by a cover plate, or similar, arranged on the front surface of the household appliance. Thereby, a household appliance is provided which can be built in using a material which reflects or absorb wireless signals, for example steel.

Still further, when the household appliance is positioned on a floor surface, or at a relative low position in a home, or in another suitable place, the communication unit will be visually hidden for a user since it is arranged at the first delimiting surface which is a delimiting surface of the recess being essentially parallel to the underside of the body.

Accordingly, a household appliance is provided overcoming, or at least alleviating, at least some of the above-mentioned problems and drawbacks. As a result, the above-mentioned object is achieved.

Optionally, the recess extends along the entire width of the body. Thereby, a household appliance is provided in which a build in component, such as a wooden plank, or similar, can be arranged to extend along the entire width of the body along the second delimiting surface.

Optionally, the first delimiting surface comprises an opening, wherein the communication module is arranged in the opening. Thereby, the transmission of wireless signals is further ensured in a simple and effective manner.

Optionally, at least a portion of the communication module extends through the opening. Thereby, the transmission of wireless signals is further ensured in a simple and effective manner.

Optionally, the communication module comprises a cover made from plastic. Thereby, the transmission of wireless signals is further ensured in a simple and effective manner.

Optionally, the household appliance further comprises a control unit configured to control operation of the household appliance, wherein the communication module is connected to the control unit. Thereby, a household appliance is provided which may allow remote control of the household appliance, and/or may communicate data related to the operation of the household appliance.

Optionally, the communication module is configured to wirelessly transmit and/or receive data related to the operation of the household appliance. Thereby, a household appliance is provided which may allow remote control of the household appliance, and/or may communicate data related to the operation of the household appliance. As a result, a more user-friendly household appliance can be provided.

Optionally, the communication module is configured to wirelessly transmit data to, and/or receive data from, a remote Wireless network router. Thereby, a household appliance is provided capable of wirelessly transmit data to, and/or receive data from, a device usually being present in a home, i.e. a Wireless network router. Thus, a household appliance is provided which may circumvent the need for buying a separate communication unit for wirelessly transmitting data to, and/or receive data from, the communication module of the household appliance.

Optionally, the household appliance is a built-in household appliance, wherein the front side comprises means for fastening a cover plate onto the front side. Since the communication module is arranged at the first delimiting surface, which is a delimiting surface of the recess, the communication module is located at a position of the household appliance ensuring that the transmission of wireless signals will not be disturbed by the cover plate when the cover plate is arranged on the front surface of the household appliance. Thereby, a household appliance is provided which can be built in using a cover plate of a material which reflects or absorb wireless signals, such as for example a stainless-steel cover plate.

Optionally, the household appliance is a dishwasher. Thereby, a dishwasher is provided in which the transmission of wireless signals will be less sensitive to disturbances of surrounding materials giving a greater freedom of positioning the dishwasher within a home. This because the communication module of the dishwasher is arranged at the first delimiting surface which is a delimiting surface of the recess which provides a path where the wireless signals can be transmitted without having to pass through the material of a surface.

Further, a dishwasher is provided having an improved ability to be built in. That is, since the communication module of the dishwasher is arranged at the first delimiting surface which is a delimiting surface of the recess, the communication module is located at a position of the dishwasher ensuring that the transmission of wireless signals will not be disturbed by a cover plate arranged on the front surface of the dishwasher. Thereby, a dishwasher is provided which can be built in using a material which reflects or absorb wireless signals, for example steel.

Still further, when the dishwasher is positioned on a floor surface, or at a relative low position in a home or in another suitable place, the communication unit will be visually hidden for a user since it is arranged at the first delimiting surface which is a delimiting surface of the recess being essentially parallel to the underside of the body.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1:
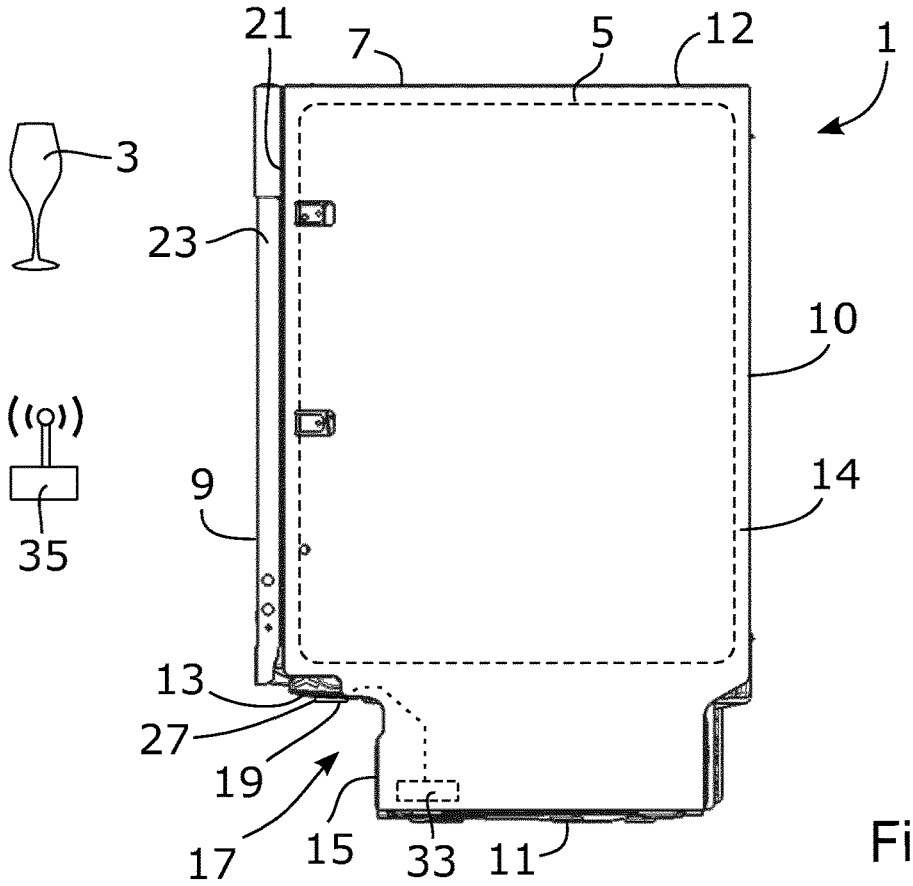
FIG. 1 illustrates a side view of a household appliance, according to some embodiments.

FIG. 1 illustrates a side view of a household appliance 1, according to some embodiments. According to the illustrated embodiments, the household appliance 1 is a dishwasher. According to further embodiments, the household appliance 1 may be a refrigerator, a freezer, an oven, a stove, a washing machine, a dryer, or the like. The household appliance 1 is configured to perform a useful cycle of operation on an item 3. Since the household appliance according to the illustrated embodiments is a dishwasher, the household appliance 1 is configured to perform a useful cycle of operation in the form of a washing cycle of items 3 such as glasses, cutlery, plates, etc.

The household appliance 1 comprises a treating chamber 5 for accommodating the item 3 during the performance of the useful cycle. The household appliance 1 comprises a body 7 enclosing the treating chamber 5. The body 7 comprises an open section 21 at a front side 9 allowing access to the treating chamber 5, and a door 23 arranged at the front side 9 to provide a closure of the open section 21. The body 7 comprises the front side 9, a back side 10, an underside 11, a top side 12, a first side 14, and a second side (not visible in FIG. 1). In FIG. 1, the household appliance 1 is illustrated as being viewed from the first side 14. The second side is opposite to the first side 14. During use, the household appliance 1 is configured to be placed in an upright use position with the underside 11 on an essentially flat surface. The top side 12 is opposite to the underside 11. The underside 11 may also be referred to as the base of the household appliance 1. The front side 9 is opposite to the back side 10 of the household appliance 1 and is thus configured to face a room, such as a kitchen, when the household appliance 1 is installed. When the household appliance 1 is placed in the upright use position, the front side 9, the back side 10, the first side 14, and the second side will extend essentially in vertical directions, and the underside 11 and the top side 12 will extend essentially in horizontal directions.

The body 7 further comprises a first delimiting surface 13 and a second delimiting surface 15. The first and second delimiting surfaces 13, 15 forms a recess 17 between the underside 11 and the front side 9 of the body 7. As illustrated in FIG. 1, the first delimiting surface 13 is essentially parallel to the underside 11 of the body 7. The feature that the first delimiting surface 13 is essentially parallel to the underside 11 of the body 7 may encompass that the first delimiting surface 13 extends in a first plane, wherein the angle between the first plane and a horizontal plane, when the household appliance 1 is positioned in the upright use position, is within the range of 0-25 degrees, 0-20 degrees, 0-15 degrees, 0-10 degrees, or 0-5 degrees.

Further, as illustrated in FIG. 1, the second delimiting surface 15 is essentially parallel to the front side 9 of the body 7. The feature that the second delimiting surface 15 is essentially parallel to the front side 9 of the body 7 may encompass that second delimiting surface 15 extends in a second plane, wherein the angle between the second plane and a vertical plane, when the household appliance 1 is positioned in the upright use position, is within the range of 0-25 degrees, 0-20 degrees, 0-15 degrees, 0-10 degrees, or 0-5 degrees.

Further, according to the illustrated embodiments, the door 23 is hinged in a region of the first delimiting surface 13 of the recess 17. The first and second delimiting surfaces 13, 15 together adjoins the front side 9 and the underside 11 of the body 7.

The household appliance 1 further comprises a communication module 19 configured to wirelessly transmit and receive data. According to the illustrated embodiments, the communication module 19 is configured to wirelessly transmit data to, and receive data from, a remote wireless network router 35, for example a Wi-Fi router. The wireless communication may for example be performed over a wireless connection such as the internet, or a wireless local area network (WLAN), or a wireless connection for exchanging data over short distances using short-wavelength, i.e. ultra-high frequency (UHF) radio waves in the industrial, scientific and medical (ISM) band from 2.4 to 2.485 GHz.

The household appliance 1 comprises a control unit 33 configured to control operation of the household appliance 1. The communication module 19 is connected to the control unit 33. According to the illustrated embodiments, the communication module 19 is configured to wirelessly transmit and receive data related to the operation of the household appliance 1.

As illustrated in FIG. 1, the communication module 19 is arranged at the first delimiting surface 13. Thereby, the transmission of wireless signals will not be disturbed by surrounding surfaces giving a greater freedom of positioning the household appliance 1 within a home. This because the communication module 19 is arranged at the first delimiting surface 13 which is a delimiting surface of the recess 17. Thus, the wireless signals will not have to pass through any surface since the recess 17 provides a path where the wireless signals can be transmitted without having to pass through the material of a surface.

Further, when the household appliance 1 is positioned on a floor surface, or at a relative low position in a home or in another suitable place, the communication unit 19 will be visually hidden for a user since it is arranged at the first delimiting surface 13 which is a delimiting surface of the recess 17 being essentially parallel to the underside 11 of the body 7.

Figure 2:
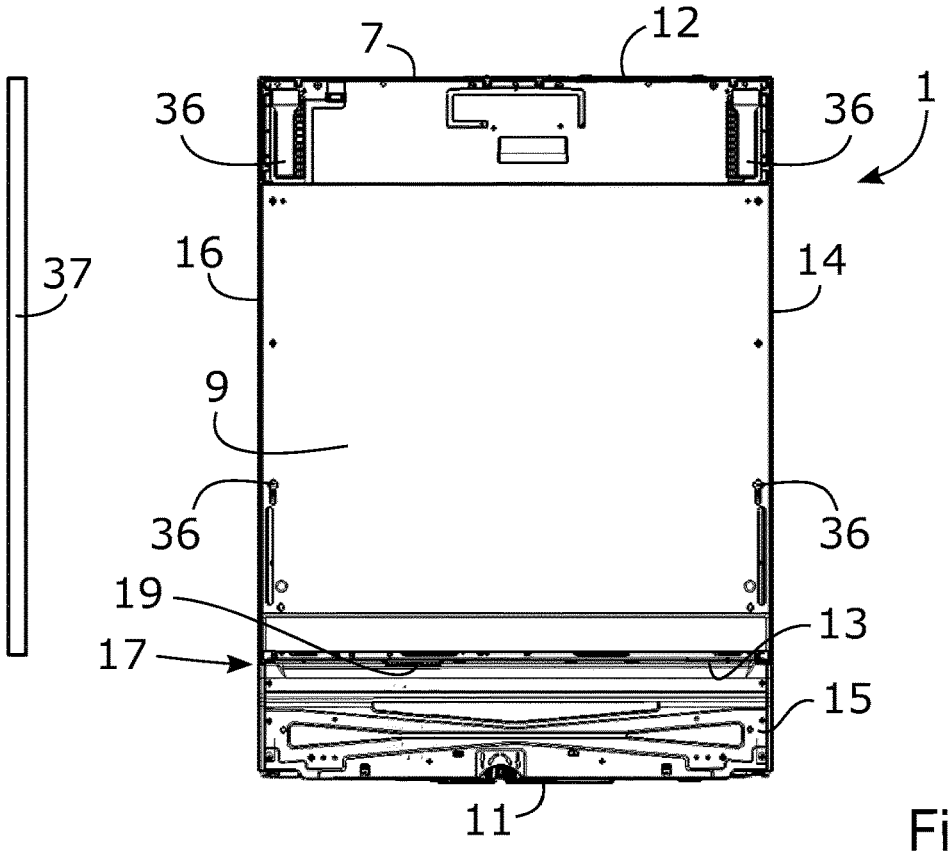
FIG. 2 illustrates a front side view of the household appliance illustrated in FIG. 1.

FIG. 2 illustrates a front side view of the household appliance 1 illustrated in FIG. 1. Thus, in FIG. 2, the household appliance 1 is illustrated as being viewed from the front side 9. Further, in FIG. 2, the underside 11, the top side 12, the first side 14, and the second side 16 are indicated.

According to the illustrated embodiments, the household appliance 1 is a built-in household appliance 1, wherein the front side 9 comprises means 36 for fastening a cover plate 37 onto the front side 9. In FIG. 2, the cover plate 37 is illustrated as being viewed from the side. According to the illustrated embodiments, the cover plate 37 has a front area and dimensions, i.e. width and height, essentially corresponding to the dimensions of the door 23 of the household appliance 1. According to the illustrated embodiments, the means 36 comprises apertures in the front side 9 configured to receive fastening elements such as screws, bolts, and a portion of a bracket element. Since the door 23 is arranged at the front side 9, according to the illustrated embodiments, the door 23 comprises the means 36 for fastening a cover plate 37 onto the door 23.

Since the communication module 19 is arranged at the first delimiting surface 13 which is a delimiting surface of the recess 17, the communication module 19 is located at a position of the household appliance 1 ensuring that the transmission of wireless signals will not be disturbed by the cover plate 37 when arranged on the front surface 9 of the household appliance 1, i.e. according to the illustrated embodiments, when the cover plate 37 is arranged on the door 23 of the household appliance 1. Accordingly, a household appliance 1 is provided which can be built in using a material which reflects or absorb wireless signals, for example a stainless-steel material.

As seen in FIG. 2, according to these embodiments, the recess 17 extends along the entire width of the body 7. Thereby, a household appliance 1 is provided in which a build in component, such as a wooden plank, can be arranged to extend along the entire width of the body along the second delimiting surface 15. Since the communication module 19 is arranged at the first delimiting surface 13, such a build in component will not disturb transmission of wireless signals, and can thus also be provided in a material which reflects or adsorbs wireless signals.

Figure 3:
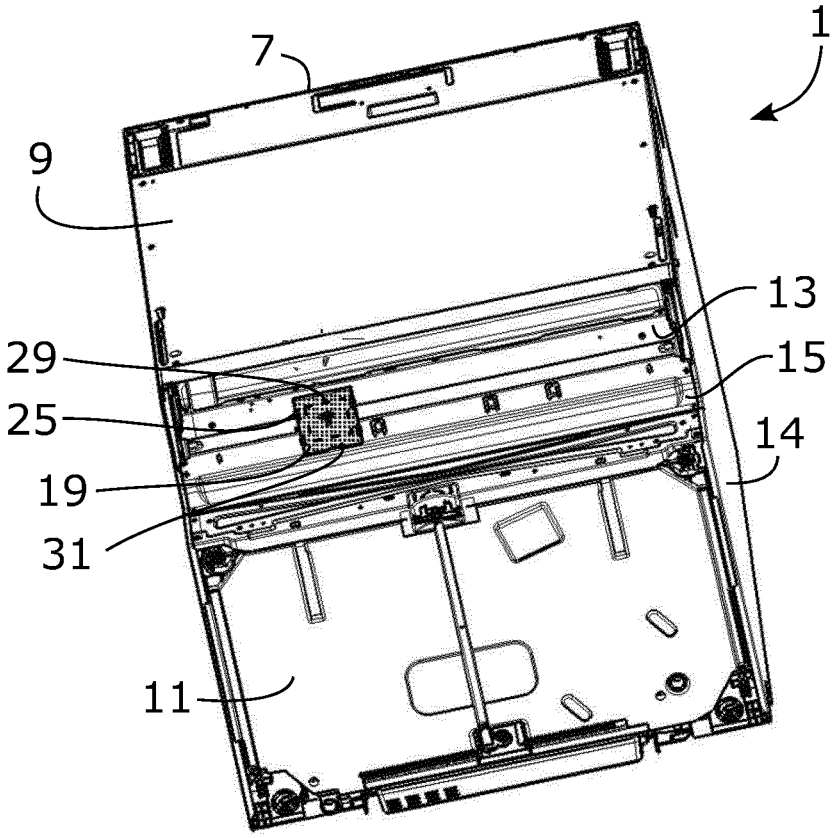
FIG. 3 illustrates a perspective view of the household appliance illustrated in FIG. 1 and FIG. 2, from an underside of a body of the household appliance.

FIG. 3 illustrates a perspective view of the household appliance 1 illustrated in FIG. 1, and in FIG. 2, from the underside 11 of the body 7. In the perspective view of FIG. 3, also the front side 9, the first side 14, the first delimiting surface 13, and the second delimiting surface 15 are visible. According to the illustrated embodiments, the first delimiting surface 13 comprises an opening 25. The communication module 19 is arranged in the opening 25. Thereby, the transmission of wireless signals to and/or from the communication module 19 is further ensured in a simple and effective manner.

Further, according to the illustrated embodiments, the communication module 19 comprises at least one antenna 29 configured to wirelessly transmit and/or receive the data. The communication module 19 further comprises a cover 31 made from plastic. Thereby, the transmission of wireless signals to and/or from the communication module 19 is further ensured in a simple and effective manner.

According to the illustrated embodiments, the first delimiting surface 13 forms part of a kick plate of the household appliance 1. The kick plate extends from the first side 14 to the second side 16. One of the purposes of the kick plate is to give structural strength to the household appliance 1. According to some embodiments, the first delimiting surface 13, as referred to herein, may also be referred to as the kick plate.

Further, as indicated in FIG. 1, and as also can be seen in FIG. 2 and FIG. 3, at least a portion 27 of the communication module 19 extends through the opening 25. As a result, the transmission of wireless signals to and/or from the communication module 19 is further ensured in a simple and effective manner.

Still further, as can be seen in FIG. 1, as well as in FIG. 3, a horizontal cross section of the body 7 at the second delimiting surface 15 is smaller than a horizontal cross section of the body 7 at the front side 9. This because the first delimiting surface 13 is essentially parallel to the underside 11 of the body 7, and the first and second delimiting surfaces 13, 15 together adjoins the front side 9 and the underside 11 of the body 7

It is to be understood that the foregoing is illustrative of various example embodiments and that the invention is defined only by the appended claims. A person skilled in the art will realize that the example embodiments may be modified, and that different features of the example embodiments may be combined to create embodiments other than those described herein, without departing from the scope of the present invention, as defined by the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A household appliance configured to perform a useful cycle of operation on an item, the household appliance comprising:

a treating chamber for accommodating the item during the performance of the useful cycle;

a body enclosing the treating chamber, the body including:

a front side, an underside, a first delimiting surface external to the body, and a second delimiting surface, wherein the first and second delimiting surfaces form a recess between the underside and the front side, and the first delimiting surface is essentially parallel to the underside of the body; and a communication module configured to wirelessly transmit and/or receive data, the communication module is arranged:

on the first delimiting surface such that the communication module is exposed externally to the body, or in an opening in the first delimiting surface such that the communication module is exposed externally to the body.

2. The household appliance according to claim 1, wherein the body comprises an open section at the front side allowing access to the treating chamber, and a door arranged at the front side to provide a closure of the open section.

3. The household appliance according to claim 2, wherein the door is hinged in a region of the first delimiting surface of the recess.

4. The household appliance according to claim 1, wherein the first and second delimiting surfaces together adjoins the front side and the underside of the body.

5. The household appliance according to claim 1, wherein the recess extends along the entire width of the body.

6. The household appliance according to claim 1, wherein the second delimiting surface is essentially parallel to the front side of the body.

7. The household appliance according to claim 1, wherein at least a portion of the communication module extends through the opening.

8. The household appliance according to claim 1, wherein the communication module comprises at least one antenna configured to wirelessly transmit and/or receive the data.

9. The household appliance according to claim 1, wherein the communication module comprises a cover made from plastic.

10. The household appliance according to claim 1, further comprising a control unit configured to control operation of the household appliance, wherein the communication module is connected to the control unit.

11. The household appliance according to claim 10, wherein the communication module is configured to wirelessly transmit and/or receive data related to the operation of the household appliance.

12. The household appliance according to claim 1, wherein the communication module is configured to wirelessly transmit data to, and/or receive data from, a remote Wireless network router.

13. The household appliance according to claim 1, wherein the household appliance is a built-in household appliance, wherein the front side comprises means for fastening a cover plate onto the front side.

14. The household appliance according to claim 1, wherein the household appliance is a dishwasher.

* * * * *